US012616309B2

(12) United States Patent
Miller

(10) Patent No.: US 12,616,309 B2
(45) Date of Patent: May 5, 2026

(54) APPARATUS FOR USE WITH PORTABLE HEAD SUPPORT

(71) Applicant: Andrew Miller, Powder Springs, GA (US)

(72) Inventor: Andrew Miller, Powder Springs, GA (US)

( * ) Notice: Subject to any disclaimer, the term of this patent is extended or adjusted under 35 U.S.C. 154(b) by 321 days.

(21) Appl. No.: 18/324,956

(22) Filed: May 27, 2023

(65) Prior Publication Data

US 2023/0292929 A1 Sep. 21, 2023

Related U.S. Application Data

(63) Continuation-in-part of application No. 17/826,337, filed on May 27, 2022, now Pat. No. 11,659,935, which is a continuation of application No. 17/215,858, filed on Mar. 29, 2021, now Pat. No. 11,344,130, which is a continuation of application No. 16/541,240, filed on Aug. 15, 2019, now Pat. No. 10,980,349, which is a continuation of application No. 15/656,455, filed on Jul. 21, 2017, now Pat. No. 10,383,451, which is a continuation-in-part of application No. 15/078,704, filed on Mar. 23, 2016, now Pat. No. 9,770,113.

(51) Int. Cl.
*A47C 16/00* (2006.01)
*A47C 7/38* (2006.01)

(52) U.S. Cl.
CPC ..... *A47C 16/00* (2013.01); *A47C 7/383* (2013.01)

(58) Field of Classification Search
CPC ..... A47C 16/00; A47C 7/383
See application file for complete search history.

(56) References Cited

U.S. PATENT DOCUMENTS

| | | | | | |
|---|---|---|---|---|---|
| 4,673,117 | A * | 6/1987 | Calton | A45C 11/20 | 224/259 X |
| 5,154,332 | A * | 10/1992 | Williams | A45F 3/04 | 224/153 |
| 5,611,601 | A * | 3/1997 | Cowgur | A47C 7/383 | 5/652 |
| 6,279,796 | B1 * | 8/2001 | Trevino | A45C 13/002 | 224/153 |
| 2011/0127815 | A1 * | 6/2011 | Nickerson | A47C 7/0213 | 297/219.1 X |
| 2020/0352294 | A1 * | 11/2020 | Davis | A45C 7/0068 | |

* cited by examiner

*Primary Examiner* — Anthony D Barfield
(74) *Attorney, Agent, or Firm* — HILL, KERTSCHER & WHARTON, LLP; Gregory T. Ourada

(57) ABSTRACT

An accessory for use with a backpack or other carry-on item having a front side with one or more arm loops and a back side featuring a pocket for holding a portable head support. The accessory may be in the form of a slipcover that fits over the carry-on item. Other embodiments in which the arm loops and the pocket attach to the carry-on item using pre-existing attachment mechanisms that are built into the carry-on item are contemplated.

4 Claims, 3 Drawing Sheets

APPARATUS FOR USE WITH PORTABLE HEAD SUPPORT

CROSS-REFERENCE TO RELATED APPLICATIONS

This application is a continuation-in-part of Appl. U.S. Ser. No. 17,826,337, filed May 27, 2022, now U.S. Pat. No. 11,659,935, which is a continuation of application Ser. No. 17/215,858, filed Mar. 29, 2021, now U.S. Pat. No. 11,344,130, which is a continuation of application Ser. No. 16/541,240, filed Aug. 15, 2019, now U.S. Pat. No. 10,980,349, which is a continuation of application Ser. No. 15/656,455, filed Jul. 21, 2017, now U.S. Pat. No. 10,383,451, which is a continuation-in-part of application Ser. No. 15/078,704 filed Mar. 23, 2016, now U.S. Pat. No. 9,770,113, all of which are incorporated herein in their entirety.

BACKGROUND OF THE INVENTION

People who travel, especially those who travel by plane, train, or bus, are faced with the problem of trying to comfortably rest in waiting areas and on board a vehicle. Some airports, train stations, and bus terminals may provide lounges where travelers can lie down to sleep. Travelers who fly first class, or who can afford sleeper cabins on board a train may be provided with seats that comfortably recline, or an actual bed, but such amenities are not available to the vast majority of travelers who are instead confined to a sitting position. For these persons, sleep deprivation is one of the most unpleasant aspects of travel. Certain solutions such as neck pillows alleviate the problem somewhat by providing head support. However, for some travelers who prefer to sleep in the prone position, i.e. face-down, or on their side, neck pillows do not provide an optimal solution. Sleeping with one's head on a folded-down tray table is also not an optimal solution. Clearly, a solution that provides more of a sensation of "lying down" for these travelers is very desirable.

Solutions to this problem are described in U.S. Pat. Nos. 9,770,113, 10,383,451, 10,980,349 and 11,344,130, the disclosures of which are incorporated herein in their entirety. The embodiments described in these patents consist of (1) a baseboard, i.e. a support panel that slides into and is held in place inside a carry-on backpack or other item of hand-carried luggage and (2) a head support. The baseboard and the head support are joined by a hinge having an adjustable range of motion allowing the head reclining angle to be easily adjusted. The embodiments are designed to be compact, easy-to-use, and optimize limited space. It was also noted that holding a backpack or other carry-on on one's lap with the arms while using the portable head support also provides some support to the traveler's torso as well. However, when a traveler falls asleep, the arms tend to fall, which may cause the position of the backpack or carry-on item to shift, waking the user up.

SUMMARY OF THE INVENTION

The embodiments described herein remedy this undesirable result. One embodiment is a slipcover that fits over a backpack or carry on item. One side of the slipcover has at least two arm loops that will hold a sleeper's arms in place. The other side of the slipcover in this embodiment is a pocket specially designed to hold the portable head support described in U.S. Pat. Nos. 9,770,113, 10,383,451, 10,980,349 and 11,344,130, examples of which are shown in FIGS. 4 and 5. In other embodiments, the arm loops are incorporated into the carry-on item itself. In other embodiments the arm loops and portable head support may be detachable from the carry-on item using a variety of detachable fasteners (e.g., hook-and-loop, MOLLE/PALS, etc.) known to the art. One embodiment that fits over a backpack will be described in detail below.

DETAILED DESCRIPTION OF THE INVENTION

The invention is described in preferred embodiments in the following description with reference to the Figures, in which like numbers represent the same or similar elements. Reference throughout this specification to "one embodiment", "an embodiment", or similar language means that particular feature, structure, or characteristic described in connection with the embodiment is included in at least one embodiment of the present invention. Thus, appearances of the phrases "in one embodiment", "in an embodiment", "in certain embodiments", and similar language throughout this specification may, but do not necessarily, all refer to the same embodiment. It is noted that, as used in this description, the singular forms "a", "an", and "the" include plural referents unless the context clearly dictates otherwise.

Figure 1:
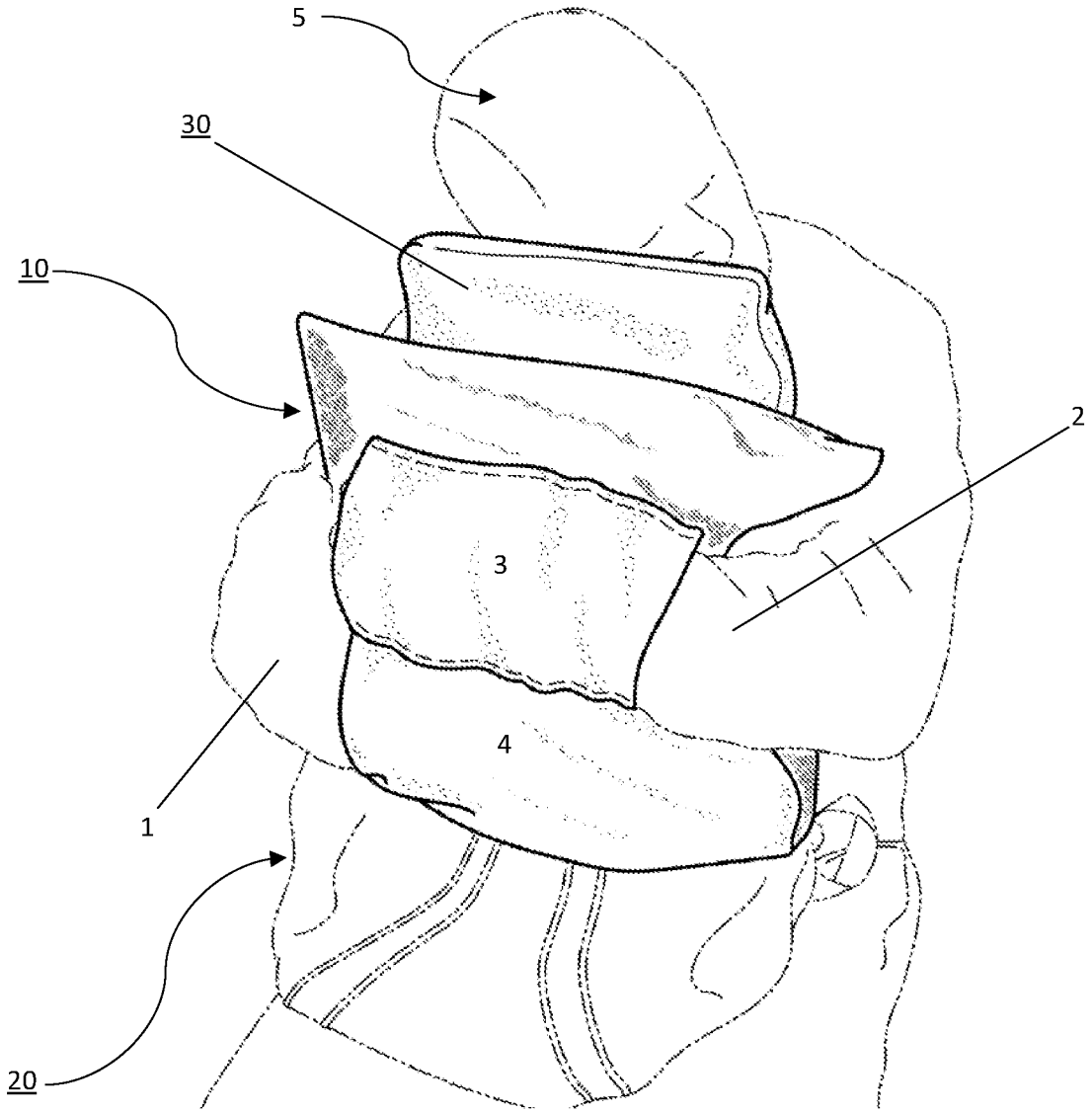
FIG. 1 is a perspective illustration of one embodiment of the invention in use.
Figure 2:
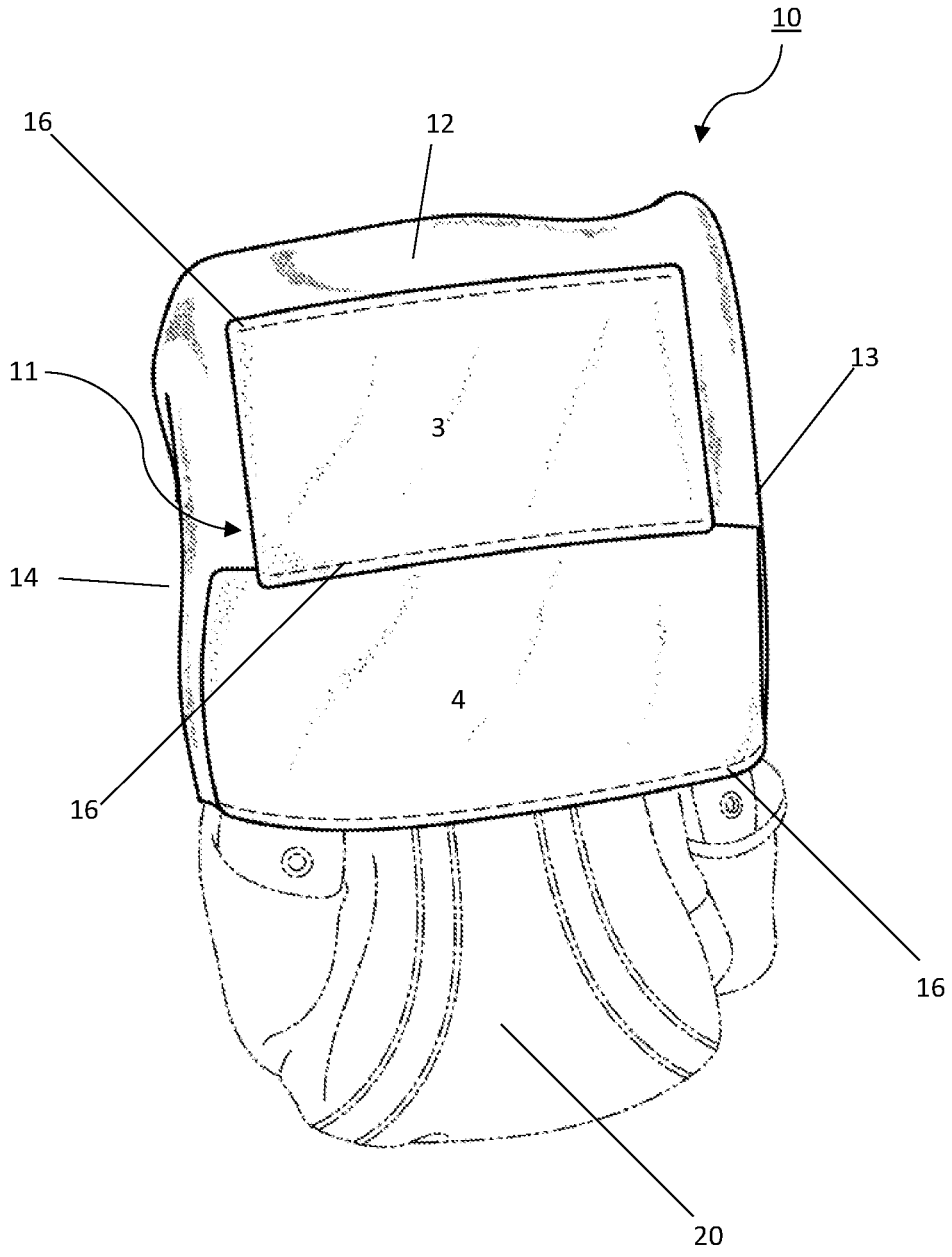
FIG. 2 shows one embodiment of the invention from the front side, illustrating the arm loops.
Figure 3:
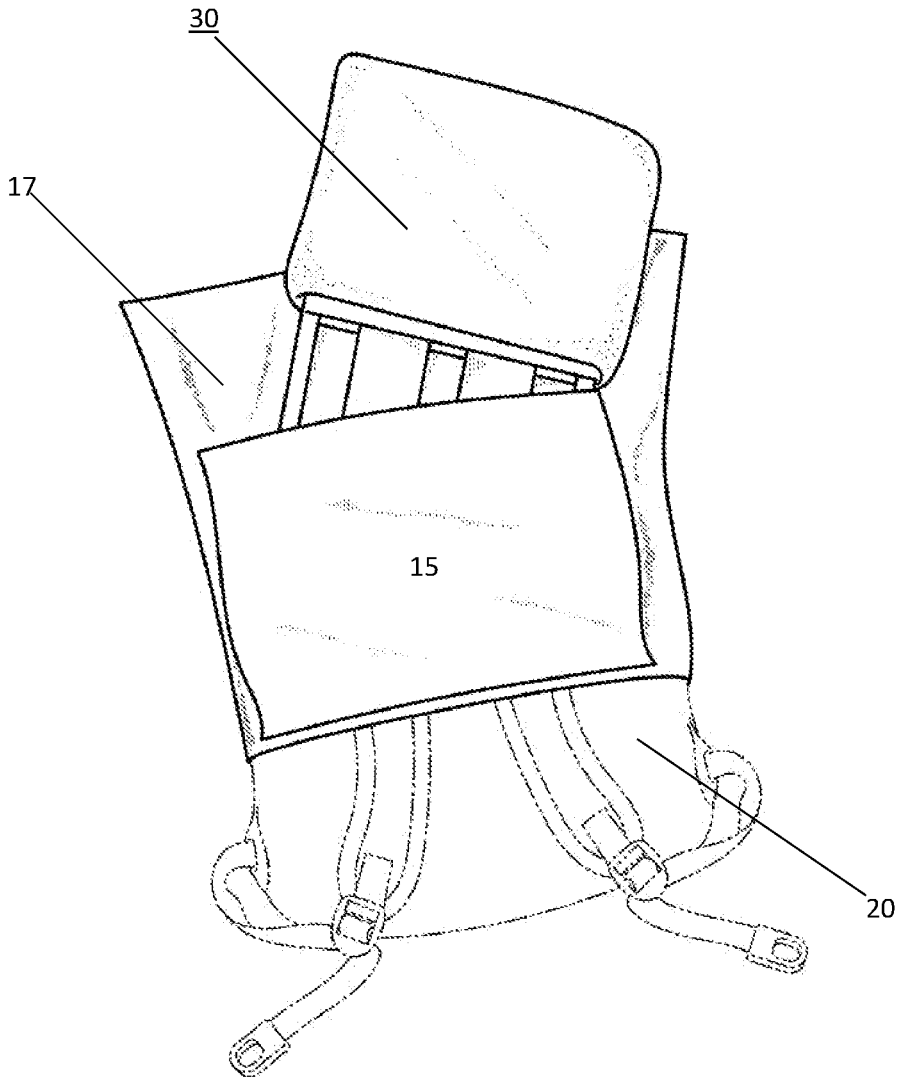
FIG. 3 shows the rear side of one embodiment of the invention illustrating the pocket for holding the portable head support.

FIG. 1 illustrates one preferred embodiment of the slipcover 10 in use with a backpack 20 with a portable head support 30. Slipcover 10 can consist of one or more sheets of fabric sewn together such that slipcover has a front side 11, a top 12, left side 13, right side 14, back side 17, pocket 15, and arm loops 3 and 4. The slipcover is sized to fit over a carry on item such as a backpack 20 that can be carried on a user's lap when the user is seated on a train, bus, or aircraft. The user's arms 1, 2 are inserted into arm loops 3, 4 which are attached to the front side 11 of slipcover 10, as illustrated in FIG. 2. User's head 5 is supported by portable head support 30, which fits into pocket 15 on the rear side of the slipcover, as illustrated in FIG. 3.

Portable head support 30 is described in detail in U.S. Pat. Nos. 9,770,113, 10,383,451, 10,980,349 and 11,344,130, the disclosures of which are incorporated herein in their entirety. Portable head support 30 generally is comprised of two flat panels which are joined by a hinge having a limited range of motion. The first panel is intended to be inserted inside pocket 15 and provides support for the second panel. The second panel acts as a headrest, and can be covered by a variety of detachable cushions which can be selected by the user. In some embodiments shown in U.S. Pat. No. 9,770,113, the second panel may have an opening designed to accommodate a user's face. The second panel extends out of pocket 15 and its angle relative to the first panel is adjustable. In some embodiments, portable head support 30 is collapsible, where the second panel can overlap and slide parallel to the first panel to a fully-collapsed state, which facilitates storage of portable head support when it is not in use.

In the embodiment shown in the Figures, arm loops 3 and 4, and pocket 15 are permanently attached to the slipcover by stitches 16. However, arm loops 3 and 4, and pocket 15 may be constructed so that they can be removed from slipcover 10. For example, snap fasteners may be used, or hook-and-loop material can be used on slipcover 10, arm loops 3 and 4, and pocket 15. Thus, in one embodiment, instead of being stitched directly to the slipcover 10, front side 11 and back side 17 of slipcover 10 may be covered in hook-and-loop material, and arm loops 3 and 4, and pocket 15 are covered on one side with the complimentary side of hook-and-loop material so that arm loops 3 and 4, and pocket 15 can be removably attached. Having these components attached in this fashion is desirable to accommodate different-sized users.

Other embodiments may omit slipcover 10. In these embodiments, arm loops 3 and 4, and pocket 15 may interface with an existing attachment system embodied in the carryon or backpack 20. For example, many backpacks have an integrated PALS attachment system. One embodiment features arm loops 3, 4 with MOLLE straps on the rear side of the arm loops which can be used with a backpack 20 or other carry on having a PALS attachment system. in these embodiments, the portable head support 30 may be located in an existing pocket of the carry-on item as disclosed in U.S. Pat. Nos. 9,770,113, 10,383,451, 10,980,349 and 11,344,130.

The terminology used above is for the purpose of reference only, and is not intended to be limiting. For example, terms such as "front", "back", "top", "bottom", etc. refer to directions in the Figures to which reference is made. While this invention has been described in conjunction with the specific embodiments outlined above, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the preferred embodiments of the invention as set forth above are intended to be illustrative, not limiting. Various changes may be made without departing from the spirit and scope of the inventions as defined in the following claims.

Finally, citation or identification of any document in this application is not an admission that such document is available as prior art to the present invention.

The invention claimed is:

1. An apparatus with a portable head support for use with a carry-on item, wherein the portable head support comprises a first panel and a second panel joined by a hinge, wherein the second panel overlaps the first panel in a first configuration, and wherein the second panel is capable of rotating relative to the first panel in a second configuration in which the second panel and the first panel are disposed such that an edge of the second panel engages an edge of the first panel at the hinge the apparatus comprising:

a slipcover comprising: a front side, a back side, a left side, a right side, and a top;

at least two arm loops in the form of elongated sleeves disposed parallel one above the other attached to the front side; and a pocket attached to the back side, wherein the pocket is adapted to accommodate the portable head support;

wherein the slipcover is adapted to slide over the carry-on item.

2. The apparatus of claim 1, wherein the at least two arm loops and the pocket are detachable from the slipcover.

3. The apparatus of claim 2, wherein the at least two arm loops and the pocket are attached to the slipcover using hook-and-loop material.

4. The apparatus of claim 2, wherein the at least two arm loops and the pocket are detachably fastened to the slipcover using snap fasteners.

* * * * *